US007052394B2

(12) United States Patent
Walker et al.

(10) Patent No.: US 7,052,394 B2
(45) Date of Patent: May 30, 2006

(54) SYSTEM AND METHOD FOR CONDUCTING AND PLAYING A SUPPLEMENTAL LOTTERY GAME

(75) Inventors: Jay S. Walker, Ridgefield, CT (US); Daniel E. Tedesco, New Canaan, CT (US); James A. Jorasch, Stamford, CT (US); John M. Packes, Jr., Hawthorne, NY (US); Magdalena Mik, Greenwich, CT (US); Stephen C. Tulley, Stamford, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 10/272,125

(22) Filed: Oct. 15, 2002

(65) Prior Publication Data

US 2003/0047869 A1 Mar. 13, 2003

Related U.S. Application Data

(63) Continuation of application No. 09/528,595, filed on Mar. 20, 2000, now Pat. No. 6,497,408.

(51) Int. Cl.
*A63F 9/00* (2006.01)

(52) U.S. Cl. ..... 463/17; 273/269

(58) Field of Classification Search ..... 463/16–20, 463/40–42; 273/138.1, 139, 138.2, 269–270, 273/292

See application file for complete search history.

(56) References Cited

U.S. PATENT DOCUMENTS

| | | | | |
|---|---|---|---|---|
| 4,669,731 A | | 6/1987 | Clarke | 273/143 R |
| 5,083,784 A | | 1/1992 | Nilssen | 273/138 R |
| 5,186,463 A | * | 2/1993 | Marin et al. | 463/27 |
| 5,269,521 A | | 12/1993 | Rossides | 273/138 R |
| 5,273,281 A | * | 12/1993 | Lovell | 273/138.1 |
| 5,472,196 A | | 12/1995 | Rusnak | 273/138 R |
| 5,620,182 A | | 4/1997 | Rossides | 273/138.2 |
| 5,628,684 A | | 5/1997 | Bouedec | 463/17 |
| 5,772,511 A | | 6/1998 | Smeltzer | 463/17 |

(Continued)

OTHER PUBLICATIONS

Phillips, Owen R. et al., "Sunk and Opportunity Costs in Valuation and Bidding", Southern Economic Journal, Jul. 1991, vol. 58, No. 1, pp. 112-128.

(Continued)

*Primary Examiner*—Xuan M. Thai
*Assistant Examiner*—Alex F. R. P. Rada, II
(74) *Attorney, Agent, or Firm*—Michael D. Downs

(57) ABSTRACT

System and methods are provided for conducting and for playing a supplemental lottery game. In accordance with some embodiments, a system and method are provided for performing a meta-game award analysis, upon completion of a primary lottery drawing, by comparing each of the primary lottery drawing entry numbers of a group of primary lottery entries with a list of winning numbers from the primary lottery drawing, and determining if the meta-game award analysis indicates that the group of entries qualifies for a meta-game award.

42 Claims, 11 Drawing Sheets

132

| NUMBER OF PRIMARY LOTTERY ENTRIES REGISTERED 134 | REGISTRATION PRICE PER PRIMARY LOTTERY ENTRY 136 | GROUP REGISTRATION PRICE 138 | AVAILABLE AWARD(S) 140 | PRIMARY LOTTERY AWARD THRESHOLD 142 |
|---|---|---|---|---|
| 1 | $0.25 | $0.25 | $0.35 OR 15 CREDIT POINTS | ----- |
| 2 | $0.25 | $0.50 | $0.52 OR 20 CREDIT POINTS | ----- |
| 5 | $0.25 | $1.25 | $1.37 OR 30 CREDIT POINTS | 2 WINNING PRIMARY LOTTERY ENTRIES |
| 10 | $0.25 | $2.50 | $3.01 OR 60 CREDIT POINTS OR 3 FREE LOTTERY ENTRIES | ----- |
| 20 | $0.20 | $4.00 | $7.27 OR 140 CREDIT POINTS | $5.00 |
| 30 | $0.20 | $6.00 | $13.15 OR 260 CREDIT POINTS OR $25.00 MERCHANDISE COUPON | $1.00 PER ENTRY |

U.S. PATENT DOCUMENTS

| | | | | |
|---|---|---|---|---|
| 5,836,816 | A | 11/1998 | Bruin et al. | 463/16 |
| 5,979,894 | A | 11/1999 | Alexoff | 273/139 |
| 6,024,641 | A | 2/2000 | Sarno | 463/17 |
| 6,086,477 | A | 7/2000 | Walker et al. | 463/17 |
| 6,099,407 | A | 8/2000 | Parker, Jr. et al. | 463/19 |
| 6,203,011 | B1 | 3/2001 | Nulph | 273/138.2 |
| 6,267,670 | B1 * | 7/2001 | Walker et al. | 463/17 |
| 6,277,026 | B1 * | 8/2001 | Archer | 463/42 |
| 6,296,250 | B1 * | 10/2001 | Langan | 273/139 |
| 6,416,408 | B1 * | 7/2002 | Tracy et al. | 463/16 |
| 6,447,395 | B1 * | 9/2002 | Stevens | 463/18 |
| 6,497,408 | B1 * | 12/2002 | Walker et al. | 273/138.1 |

OTHER PUBLICATIONS

"Supermarkets Weigh Options For Alternative Video Assn.", Communications Daily, Oct. 7, 1991.

Donnelly, John, "State lotteries try gimmick games to juice slow sales", The Houston Chronicle, Jan. 26, 1992, Section: A, p. 10.

Bradshaw, James, "Lottery Jackpot Grows to $20 Million", The Columbus Dispatch, Jun. 14, 1996, Section: News Local & National, p. 6D.

"Lottery seeks more $4 million players", San Antonio Express-News, Jul. 19, 1996, Section: p. 13, Part A.

Image File Wrapper, "Amendment in U.S. Appl. No. 10/612,307", Titled: Lottery Game Method, Filed Jul. 2, 2003, In the name of Mark Meyer et al., Download date: Aug. 1, 2005, 20 pp.

* cited by examiner

132

| NUMBER OF PRIMARY LOTTERY ENTRIES REGISTERED 134 | REGISTRATION PRICE PER PRIMARY LOTTERY ENTRY 136 | GROUP REGISTRATION PRICE 138 | AVAILABLE AWARD(S) 140 | PRIMARY LOTTERY AWARD THRESHOLD 142 |
|---|---|---|---|---|
| 1 | $0.25 | $0.25 | $0.35 OR 15 CREDIT POINTS | ----- |
| 2 | $0.25 | $0.50 | $0.52 OR 20 CREDIT POINTS | ----- |
| 5 | $0.25 | $1.25 | $1.37 OR 30 CREDIT POINTS | 2 WINNING PRIMARY LOTTERY ENTRIES |
| 10 | $0.25 | $2.50 | $3.01 OR 60 CREDIT POINTS OR 3 FREE LOTTERY ENTRIES | ----- |
| 20 | $0.20 | $4.00 | $7.27 OR 140 CREDIT POINTS | $5.00 |
| 30 | $0.20 | $6.00 | $13.15 OR 260 CREDIT POINTS OR $25.00 MERCHANDISE COUPON | $1.00 PER ENTRY |

FIG. 3

152

| GROUP IDENTIFIER 154 | PLAYER IDENTIFIER 156 | DRAWING IDENTIFIER 158 | LOTTERY NUMBER(S) 160 | AWARD 162 |
|---|---|---|---|---|
| 1111-2222-3333-4444 | 1111-2222-3333-4444 | 12-30-99 | 1-2-3-4-5-6<br>6-8-10-12-14-16 | 20 CREDIT POINTS |
| NY-1234-5678 | ----- | 12-31-99 | 20-27-30-31-32-33<br>5-10-15-20-25-30 | PENDING |
| | | 01-01-00 | 2-4-6-8-10-12<br>12-14-16-18-20-22 | |
| NY-111-222-333-1 | NY-111-222-333 | 12-31-99 | 20-21-22-23-24-25<br>20-21-22-23-24-26<br>20-21-22-23-24-27<br>20-21-22-23-24-28<br>20-21-22-23-24-29<br>20-21-22-23-24-30<br>20-21-22-23-24-31<br>20-21-22-23-24-32<br>20-21-22-23-24-33<br>20-21-22-23-24-35 | PENDING |
| G-193051 | NY-111-222-333 | 12-30-99 | 7-11-13-15-17-21<br>9-12-14-16-18-20 | NOT A META-GAME WINNER |

FIG.4

172

| PLAYER IDENTIFIER 156 | PLAYER NAME 174 | PAYMENT IDENTIFIER 176 | CONTACT INFORMATION 178 | PLAYER ACCOUNT BALANCE 180 |
|---|---|---|---|---|
| 1111-2222-3333-4444 | JOHN DOE | 1111-2222-3333-4444 | 123 FIRST ST. STAMFORD, CT 06905 | 20 POINTS |
| NY-111-222-333 | JANE DOE | CASH | DOE @AOL.COM | $1.49 |
| NY-111-222-444 | ---- | ---- | ---- | 50 POINTS |

FIG. 5

192

| DRAWING DATE 194 | WINNING NUMBERS 196 |
|---|---|
| 01-01-00 | |
| 12-31-99 | 10-11-12-13-18-19 |
| 12-30-99 | 1-2-10-11-17-18 |

FIG. 6

SYSTEM AND METHOD FOR CONDUCTING AND PLAYING A SUPPLEMENTAL LOTTERY GAME

The present application is a continuation application of U.S. patent application Ser. No. 09/528,595 (filed Mar. 20, 2000 in the name of Walker et al.), which issued as U.S. Pat. No. 6,497,408 on Dec. 24, 2002. The entirety of this application is herein incorporated by reference for all purposes.

FIELD OF THE INVENTION

The present invention relates generally to lotteries, and more particularly to a lottery involving a secondary or supplemental game.

BACKGROUND OF THE INVENTION

Lotteries have proven to be powerful and lucrative revenue generating mechanisms. In the United States, a majority of states now conduct government-sponsored lotteries which may offer daily and/or weekly jackpots ranging from hundreds to millions of dollars. These lotteries provide a steady source of income for the state to use, for example, to find state educational systems or provide capital for improvements to the state's infrastructure. Recently, many states have partnered to form multi-state lotteries which typically provide even larger jackpots due to the increased number of participants in each lottery.

In a typical operation, a lottery is operated by a central authority with a government-licensed sponsor providing much of the equipment and support necessary to establish, market, and run the operation. Such a central authority typically maintains one or more centralized operations for receiving and processing lottery entries, the entries themselves being sold at remote authorized lottery outlets or terminals.

The purchase of a lottery entry typically requires a visit to an authorized lottery outlet (e.g., in person, over the telephone, or via the Internet), where the process varies depending on the type of game to be played. In a typical Lotto-style lottery game, a player selects one or more numbers, the exact format, quantity and ordinal value range of the numbers being dependent on the type of game. In a "6/49" game, for example, six numbers are selected, each in the range from one to forty-nine. Each set of six numbers entered in a lottery drawing is referred to as an "entry." The numbers of the entry may be selected individually by the purchaser. Alternatively, many lottery authorities offer a "quick-pick" option whereby, upon request by the purchaser, a random number generator controlled by the lottery authority is used to select the numbers of the entry. In either case, the actual entry request is typically made through the completion of a sense mark form, or "bet slip," which is a machine-readable paper form having check boxes that are filled in by the purchaser or lottery agent and read by the lottery terminal. The lottery terminal typically prints a lottery "ticket" or receipt which lists each of the numbers of an entry selected by or picked for a player. The lottery ticket also typically includes a drawing identifier indicating which lottery drawing the entries are entered in. This drawing identifier is typically a drawing date, but may also be, for example, a unique number identifying a particular drawing.

As an illustrative example, if a player purchases five "quick-pick" entries in a 6/49 Lotto drawing to be held on Dec. 31, 1999, the lottery terminal first randomly selects five sets of six numbers (five different "entries") and then prints a ticket listing the five drawing entries of six numbers. The ticket will also typically include some form of drawing identifier such as, for example, the date of the drawing (in this example, Dec. 31, 1999). The player will retain the ticket or receipt until the drawing occurs as proof of entry in the drawing. Information regarding each entry is read by the lottery terminal and transmitted to a central lottery authority which keeps track of all entries in each lottery drawing. Each lottery entry is typically valid for one lottery drawing.

In a typical 6/49 Lotto-style lottery drawing, an entry "wins" an award in the drawing if at least three of the entry numbers match three of the numbers drawn in the lottery drawing. The amount of money won increases dramatically as more numbers are matched. An entry "loses" if, e.g., fewer than three numbers of the entry match the numbers drawn in the lottery drawing. No money is paid to the player for a "losing" lottery drawing entry.

For a further description of Lotto-style lottery games, including the 6/49 game, reference is made to *Dr. Z's* 6/49 *Lotto Guidebook,* by Ziemba, Dr. William T., et al., published 1986 by Dr. Z Investments, Inc., ISBN 0-9690097-2-2, incorporated herein by reference for all purposes.

While lotteries have enjoyed great success in the United States and around the world, many potential players are still discouraged from participating because the odds of winning are small. For example, in a typical 6/49 Lotto-style drawing where six numbers are picked randomly from a pool of forty-nine numbers, the odds against a player matching all six numbers in one entry is in excess of 13,000,000 to one. It is in the face of these daunting and staggering odds that many potential lottery participants are discouraged from playing more frequently or from ever participating.

Furthermore, the growing popularity of multi-state lotteries has lured players away from single-state lotteries, thereby lowering the revenue streams to these individual states. Thus, in an effort to combat increased competition in the lottery marketplace and bolster sagging consumer interest in the lottery, many lottery organizations have begun offering secondary lottery games associated with their lottery drawings. The secondary drawings give players a "second chance" at winning should the players lose in the lottery drawing. For example, some of these lotteries allow players to mail in their losing entries for a chance in a secondary drawing. The secondary drawing is essentially a "consolation round" drawing where the losers from the lottery drawing are given another chance to win a prize. Typically, in this "consolation round" drawing, the losing entries are all pooled together and one or more losing entries are drawn randomly from the pool.

Unfortunately, these secondary lottery games do not provide the player with any instant gratification since the player still has to wait for the secondary lottery drawing to occur. Further, these secondary games suffer in that the player has a chance of losing twice—once in the primary drawing and once in the secondary drawing. A player's risk of losing in the secondary drawing are similar to the player's risk of losing in the primary drawing. Because of this risk, many players are discouraged from participating in the secondary drawing.

It is therefore desirable to provide a supplementary lottery game, or "meta-game," in which a player can be guaranteed to win an award if the player fails to qualify for an award in the primary lottery game, thereby increasing participation in the lottery and providing more revenue to the organization conducting the lottery. Preferably, this meta-game provides players with instant gratification by letting them know if they have won or lost the meta-game as soon as the primary lottery game is completed.

SUMMARY OF THE INVENTION

Embodiments of the present invention provide a system and method by which players participating in a primary lottery drawing may elect to participate in a second, or derivative lottery drawing (hereinafter a "meta-game"). In one embodiment, a player plays a meta-game by first registering one or more primary lottery drawing entries to define a group. The player qualifies for an award in the meta-game if the primary lottery drawing entries of the group fail to win an award above a predetermined threshold in the primary lottery drawing.

In one embodiment of the invention, a player registers a group of primary lottery drawing entries for participation in a meta-game in conjunction with the purchase of entries in the primary lottery drawing. The registration and purchase are performed at a terminal which may be, for example, a lottery terminal which is in communication with a controller. Identifying information associated with each of the entries for the primary lottery drawing is used to register the group for the meta-game. The player also provides or arranges for some form of payment for the entry.

In another embodiment of the invention, registration for the meta-game is performed after purchase of entries in the primary lottery drawing. The player may register a group of primary lottery drawing entries for a meta-game by establishing communication with a controller, for example, using a computer to connect to the controller to register and pay for registration in the meta-game. As a part of the registration process, the player may be asked to provide registration information or the information may be automatically detected by the system. After receiving registration information and payment, the controller registers the group of primary lottery drawing entries for the meta-game and issues a confirmation to the player indicating registration in the meta-game.

The present invention gives players the chance to win an award for playing the meta-game. If a player has properly registered a group of primary lottery drawing entries for a meta-game, he or she will win a meta-game award if the registered lottery drawing entries lose in the primary lottery drawing. In one embodiment, a player is eligible for greater rewards if he or she registers a large group of primary lottery drawing entries in a meta-game. In an alternative embodiment, a group may win an award in the meta-game even if the group's entries won an award in the primary lottery drawing so long as the award is below a certain threshold.

These and other advantages and features of the present invention will become apparent, and the nature of the invention may be more clearly understood by reference to the following detailed description of the invention, the claims, and the drawings appended hereto.

BRIEF DESCRIPTION OF THE DRAWINGS

FIG. 3 is a table illustrating an exemplary data structure of a price/award database for use in the present invention;

FIG. 4 is a table illustrating an exemplary data structure of a registration database for use in the present invention;

FIG. 5 is a table illustrating an exemplary data structure of a player information database for use in the present invention;

FIG. 6 is a table illustrating an exemplary data structure of a winning numbers database for use in the present invention.

DETAILED DESCRIPTION

Embodiments of a meta-game system and method in accordance with the present invention will now be described with reference to the attached drawings. Generally, embodiments of the present invention allow lottery players to register a group of one or more primary lottery drawing entries in a secondary game (the "meta-game"). As used herein, the term "primary lottery drawing" is used in a general sense and is intended to include any drawing, lottery or casino type. The term "group" or "registered group" is used to describe a set of at least one primary lottery entry registered or being registered in a meta-game.

A player can receive a meta-game award based on the status of his or her registered group. For example, in one embodiment, a player who has registered a group of primary lottery drawing entries qualifies for an award in a meta-game if all of the primary lottery drawing entries in the player's group lose in the primary lottery drawing. In other embodiments, a meta-game operator or sponsor can establish other rules and thresholds governing when a player qualifies for an award. For example, rules may be established where a player qualifies for a meta-game award if the primary lottery drawing entries in the player's group fail to cumulatively win an award above a certain threshold in the primary lottery drawing. Other variations and rules will be apparent upon reading this disclosure.

Figure 1:
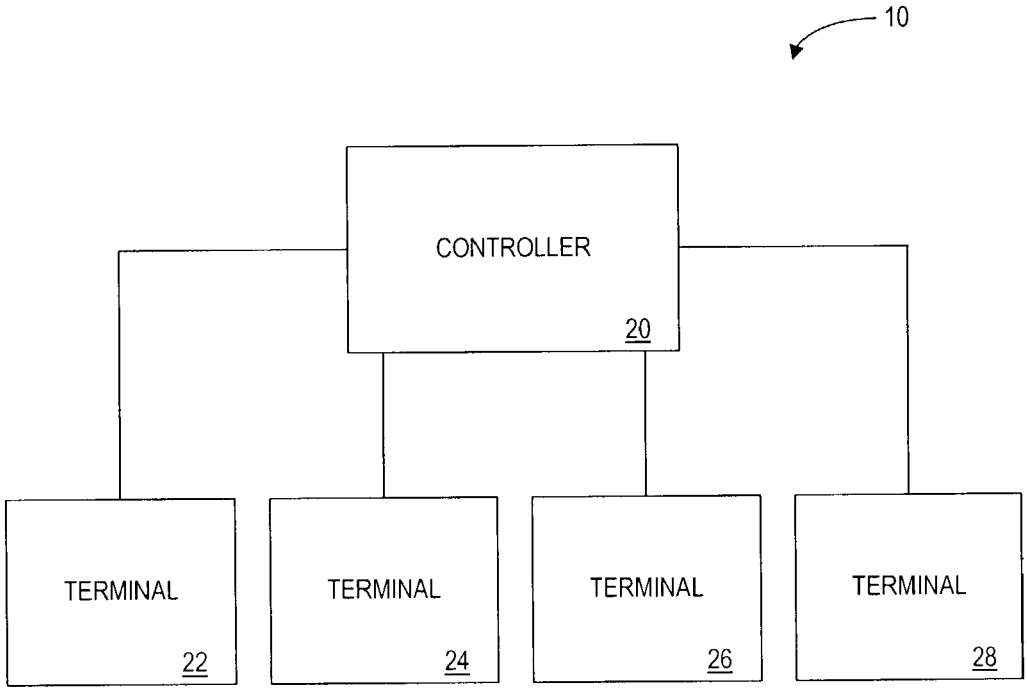
FIG. 1 is a block diagram of a system consistent with the present invention.

FIG. 1 shows a meta-game system 10 which includes a controller 20 in communication with a number of terminals 22, 24, 26 and 28. In a preferred embodiment, the terminals 22, 24, 26 and 28 are remotely located from the controller 20 to allow for distributed participation in meta-games.

The controller 20 and the terminals 22, 24, 26 and 28 are provided to facilitate meta-game registration and award distribution by a number of players at different locations. In one embodiment, the controller 20 is run by or on behalf of a meta-game authority or sponsor. In such an embodiment, the sponsor would manage and administer the meta-game in conjunction with the lottery sponsoring authority, such as a state government. As will be discussed in more detail below, embodiments of the present invention permit players to register primary lottery drawing entries for a meta-game at one terminal (e.g., at the dedicated lottery terminal where the player purchased the primary lottery drawing entries) and to receive a payout or to check the status of a meta-game at a second terminal (e.g., at a home computer or telephone). Players may also use a terminal to register a group that is different from the terminal that is used to purchase the primary lottery drawing entries in the group. Further, players may use different terminals to register different primary lottery drawing entries in a group. For example, a player may use a first terminal to register one primary lottery entry in a group and subsequently add a second entry to the group at a second terminal.

The terminals 22, 24, 26 and 28 may comprise lottery terminals, computers, kiosks, telephony devices, Automated Teller Machines (ATMs), and/or handheld electronic devices which are in communication with the controller 20 via, for example, a public or private switched telephone network, dedicated data lines, cellular, Personal Communication Systems ("PCS"), microwave, satellite networks, Internet, or any other suitable form of data communications.

Telephony devices which may be used as terminals include, for example, a Voice Response Unit (VRU) or Interactive Voice Response Unit (IVRU). Examples of IVRUs include the Vision 2001 and the Insight IVR/Web from Interactive Voice Technologies, Corp.™. and the OmniVox for Windows® NT from APEX Voice Communications®. In general, an IVRU lets a user of a DTMF (Dual Tone Multi-Frequency) tone generating telephone, also known as a "touch tone" telephone, communicate with a computer. The DTMF signals received from a user's telephone are received and interpreted by the IVRU. The IVRU may then transmit information to the user, such as an audible list of IVRU menu options.

A number of different handheld electronic devices may be used as one or more of the terminals 22–28, for example, Personal Digital Assistants (PDAs), wired or wireless telephones, one-way or two-way pagers, or the like.

Communication between any of the terminals 22–28 and the controller 20 may be direct or indirect, such as through a Web site maintained by the controller 20 on a remote server or over an online data network including commercial on-line service providers, bulletin board systems and the like. In yet other embodiments, a player may communicate with the controller 20 over RF, cable TV, satellite links and the like. For example, the meta-game registration may be performed over a cable TV link, such as by a television interfacing with a computer or other similar interface. Moreover, the computer may communicate with an output device such as a printer for printing a copy of the registration confirmation for the meta-game, as discussed above. The output device may also be used to print or distribute meta-game awards, such as coupons or certificates.

Figure 2:
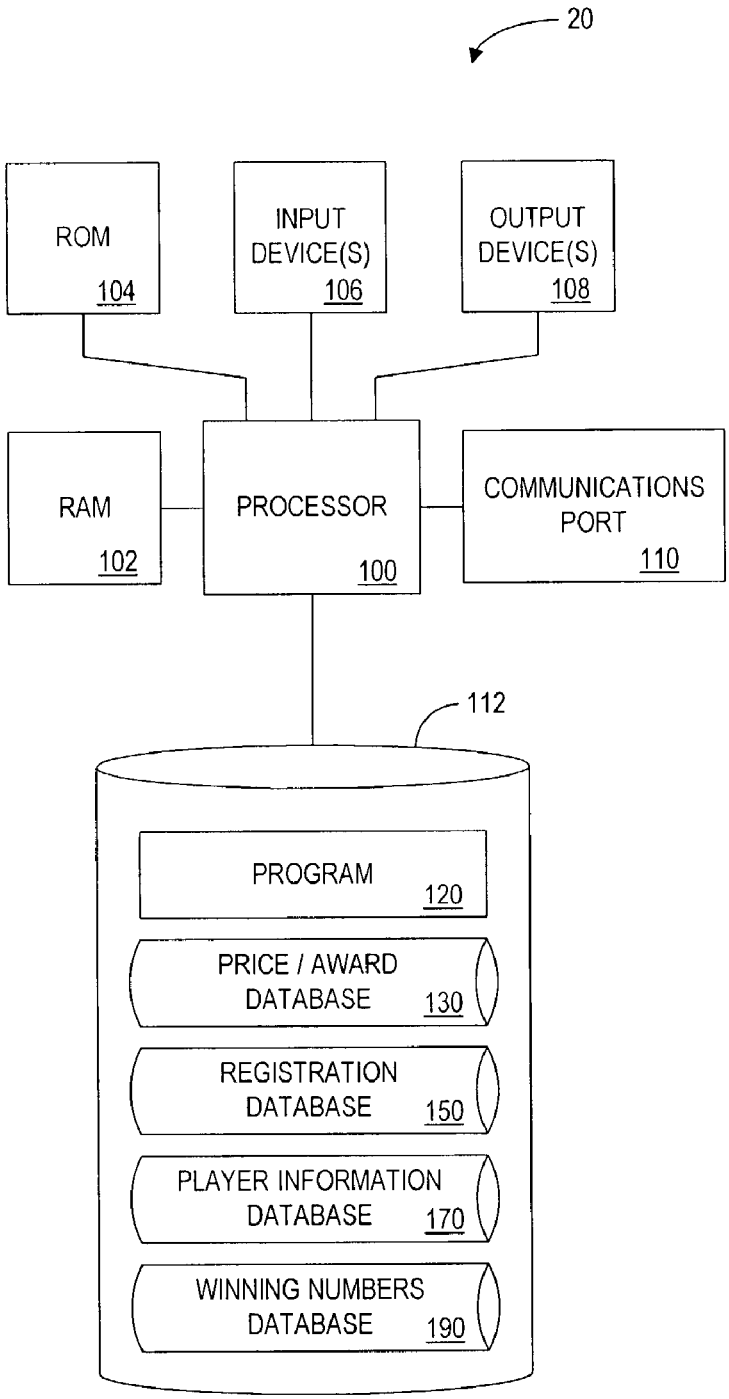
FIG. 2 is a block diagram illustrating one embodiment of the controller depicted in FIG. 1.

Referring now to FIG. 2, one embodiment of the controller 20 includes a processor 100, one or more input device(s) 106, one or more output device(s) 108, a communications port 110 and a data storage device 112. The controller 20 may be implemented as a system controller, a dedicated hardware circuit, an appropriately programmed general purpose computer, or any other equivalent electronic, mechanical or electromechanical device.

The controller 20 comprises a processor 100, such as one or more Pentium® microprocessors. If the processor 100 comprises a plurality of microprocessors, the plurality of microprocessors may or may not operate in parallel. The processor 100 is in communication with a data storage device 112. The data storage device 112 comprises an appropriate combination of magnetic, optical and/or semiconductor memory, and may include Random Access Memory (RAM), Read-Only Memory (ROM), a compact disc and/or a hard disk. The processor 100 and the storage device 112 may each be (i) located entirely within a single computer or other computing device; (ii) connected to each other by a remote communication medium, such as a serial port cable, telephone line or radio frequency transceiver; or (iii) a combination thereof. In one embodiment, the controller 20 may comprise one or more computers that are connected to a remote server computer for maintaining databases.

The data storage device 112 stores a program 120 for controlling the processor 100. The processor 100 performs instructions of the program 120, and thereby operates in accordance with the present invention, and particularly in accordance with the methods described in detail herein. The program 120 may be stored in a compressed, uncompiled and/or encrypted format. The program 120 furthermore includes program elements that may be necessary, such as an operating system, a database management system and "device drivers" for allowing the processor 100 to interface with computer peripheral devices. Appropriate device drivers and other necessary program elements are known to those skilled in the art, and need not be described in detail herein.

According to an embodiment of the present invention, the instructions of the program 120 may be read into a main memory from another computer-readable medium, such as from a ROM to a RAM (not shown). Execution of sequences of the instructions in the program 120 causes the processor 100 to perform the process steps described herein. In alternative embodiments, hard-wired circuitry may be used in place of, or in combination with, software instructions for implementation of the processes of the present invention. Thus, embodiments of the present invention are not limited to any specific combination of hardware and software.

The term "computer-readable medium" as used herein refers to any medium that directly or indirectly participates in providing instructions to the processor 100 for execution. Such a medium may take many forms, including but not limited to, non-volatile media, volatile media, and transmission media. Non-volatile media include, for example, optical or magnetic disks. Volatile media include dynamic random access memory (DRAM), which typically constitutes the main memory. Transmission media include coaxial cables, copper wire and fiber optics, including the wires that comprise a system bus coupled to the processor 100. Transmission media can also take the form of acoustic, electrical or electromagnetic waves, such as those generated during radio frequency (RF) and infrared (IR) data communications.

Some common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave such as electrical, electromagnetic or optical signals, or any other medium from which a computer can read.

Various forms of computer readable media may be involved in carrying one or more sequences of one or more instructions to the processor 100 for execution. The following example illustrates the transmission of computer-readable instructions via a plurality of media. The instructions may initially be stored on a magnetic disk of a remote computer. The remote computer can load the instructions into its dynamic memory and send the instructions over a telephone line using a modem. A modem local to the controller 20 can receive the instructions from the telephone line and use an infrared transmitter to convert the instructions into an infrared signal. An infrared detector can receive the instructions represented by the infrared signal and transmit the instructions across a system bus to the processor 100.

The system bus carries the instructions to main memory, from which the processor 100 retrieves and executes the instructions. The instructions received by main memory may optionally be stored elsewhere before or after execution by the processor 100.

The data storage device 112 also stores (i) a price/award database 130, (ii) a registration database 150, (iii) a player information database 170, and (iv) a winning numbers database 190. The databases 130, 150, 170 and 190 are described in detail below and depicted with exemplary entries in the accompanying figures. As will be understood by those skilled in the art, the schematic illustrations and accompanying descriptions of the databases presented herein are exemplary arrangements for stored representations of information. A number of other arrangements may be employed besides those suggested by the tables shown. For example, the program 120 and/or data in the various databases may be distributed between memory of the controller 20 and memory of the terminals 22–28. Similarly, the illustrated entries of the databases represent exemplary information, and those skilled in the art will understand that the number and content of the entries can be different from those illustrated herein.

One or more input device(s) 106, such as a keyboard, mouse, touch screen, microphone with a voice recognition package, or IVRU package, are operable to receive input data for the controller 20. One or more output device(s) 108 in the form of video displays, electro-luminescent arrays, liquid crystal display panels, printers, or functionally equivalent devices, are operable to output information from the controller 20.

In one embodiment, the controller 20 operates as a central server which both receives and transmits communications via communications port 110 with the terminals 22, 24, 26 and 28, as discussed earlier herein. The controller 20 should ideally be capable of handling high volume data and transaction processing and may be a conventional personal computer, a workstation, a microcomputer, or other type of computation device, typically in the form of a server computer connected to a public or private network.

Referring now to FIG. 3, a table 132 represents one embodiment of the price/award database 130 that may be stored at the data storage device 112 (FIG. 2). The table 132 includes entries identifying price and award rules for meta-games sponsored or operated by a lottery organization or lottery operator. The table 132 defines a number of fields 134–142 for each entry in the table. The fields specify (i) a number of primary lottery entries registered 134, (ii) a registration price per primary lottery entry 136, (iii) a group registration price 138, (iv) an available award(s) 140 and (v) an optional primary lottery award threshold 142. This table 132 may be established by a lottery organization and used to determine a price of registration for each group of primary lottery entries to be registered in a meta-game, and to determine what award(s) is/are available if the group qualifies for an award in a meta-game. Further, the table 132 may be used to determine when a registered group qualifies for a meta-game award (e.g., by setting a threshold to win an award).

The number of primary lottery entries registered 134 may be, for example, a number identifying a quantity of primary lottery entries that must be registered in a group to qualify for different registration prices and/or different awards. The number of primary lottery entries 134 is typically a number set by the meta-game operator or sponsor and may be used, e.g., to encourage participants to register large groups of primary lottery entries. For example, a meta-game operator or sponsor may wish to provide different price and award terms for players who register larger groups of primary lottery entries. As depicted in the example table 132 of FIG. 3, players may receive different price and award terms for registering in groups of one, two, five, ten, twenty or thirty entries at a time. In some embodiments, a player may be permitted to register a group in stages. For example, a player may register several primary lottery drawing entries in a first registration, and then later add to the group by registering several additional primary lottery drawing entries. In these embodiments, the player may be given a refund or credit if the total number of primary lottery drawing entries qualifies for a discount.

In a further embodiment, a player need not register each member of a group at the same time. Instead, primary lottery drawing entries can be registered at different times and from different terminals to form a single group.

The registration price per primary lottery entry 136 may be a number identifying a set price for registering each primary lottery entry in a meta-game. This price may be established by the lottery operator or sponsor and can be selected to encourage participants to register groups of primary lottery entries. For example, the registration price per entry 136 may be reduced (e.g., $0.20 vs. $0.25) for players who register a large group of primary lottery drawing entries (e.g., twenty or thirty vs. one or two) in a meta-game.

In one preferred embodiment of the present invention, a player is encouraged to purchase and register a large group (e.g., five or more) of primary lottery drawing entries for a meta-game. Such a group registration benefits both the player and the meta-game sponsoring authority or organization. Since the sponsor of the meta-game will be able to realize greater revenue from group sales, the sponsor will correspondingly be able to provide awards of greater value and selection to the player. Furthermore, the meta-game sponsor's liability or exposure for providing awards will be limited as the player registers more primary lottery drawing entries in a group. For example, as the player registers more primary lottery drawing entries in a group, the odds of entries of the group winning an award in the primary lottery increase, and thus the player's chances of winning a meta-game award decrease. Accordingly, the odds of the meta-game sponsor or authority having to provide a meta-game award for the group also decrease.

In an alternative embodiment, the registration price per primary lottery entry 136 is constant regardless of the number of primary lottery drawing entries being registered by a player at a given time.

The group registration price per meta-game 138 identifies a total price a player must pay to register a group of primary lottery drawing entries for a meta-game, and may be simply calculated by multiplying the number of primary lottery entries registered 134 (i.e., the size of the group) by the registration price per primary lottery entry 136. Alternatively, or in addition, the group registration price per meta-game 138 may include a fixed service fee or other cost imposed by the meta-game operator or sponsor.

The available award(s) 140 identified in the table 132 may be, for example, an alphanumeric code or other information identifying an award or awards available to a player who qualifies for a meta-game award. The available award(s) 140 may include a choice between two or more different awards (e.g., between a cash award or some alternative form of currency, such as "credit points" which may be redeemed for items of value). A player may be given the choice at the time of registration or may be given the choice when claiming an award after the primary lottery drawing. Alternatively, the controller 20 may select which award is to be presented to a particular player, e.g., based on available inventory or other criteria.

The amount of an award may vary based on the number of primary lottery entries registered 134 registered as a group for a meta-game. This further allows a meta-game operator or sponsor to encourage players to register larger groups of primary lottery entries. For example, a player who registers a single primary lottery entry may qualify to win a small cash prize or number of credit points in the meta-game, while a player who registers larger groups of primary lottery drawing entries could qualify to win meta-game awards of increasing value (actual or perceived). In the exemplary table 132 of FIG. 3, for example, a player who registers a group of five primary lottery drawing entries may qualify for a meta-game award of $1.37 or thirty credit points while a player who registers a group of thirty entries could receive a larger meta-game award of $13.15 or two hundred and sixty credit points. These potential awards are provided as illustrative examples; a wide variety of awards are possible.

In one embodiment, a meta-game sponsor may establish a primary lottery award threshold 142 which will allow a player to win a meta-game award even if one or more primary lottery drawing entries of the player's group qualifies for an award in the primary lottery drawing. In this embodiment, a player could qualify for a meta-game award so long as the total prize won by the primary lottery drawing entries of the group in the primary lottery does not exceed a certain threshold. The threshold is preferably established by the meta-game sponsor. This threshold can be a fixed value or it can vary based on different criteria. For example, a meta-game sponsor may establish a higher threshold for larger groups. As an example, a player registering a group of twenty primary lottery drawing entries may have a primary lottery award threshold of $5.00. That is, in order to qualify for a payout from the meta-game, the total primary lottery drawing payout for a player's group of twenty primary lottery drawing entries must be less than $5.00.

In alternative embodiments, the primary lottery award threshold 142 may be set such that a player may only win a set dollar amount per entry in a group. For example, if a player registers thirty entries in a group, a threshold of $1 per entry may be established so that the player qualifies for a meta-game award even if entries of his group win a total of $29 in the primary lottery drawing. As a further alternative, or in addition, the primary lottery award threshold 142 is set based on the number of entries in a group that qualify for some prize in the primary lottery drawing. For example, for a group with five primary lottery drawing entries, a meta-game sponsor may establish a threshold of two winning primary lottery drawing entries. That is, if a player registers a group of five primary lottery drawing entries, and if three of those entries win some award (of any amount) in the primary lottery drawing, the player does not win an award in the meta-game based on that group.

In an alternative embodiment, the price/award database 130 may also include information such as the odds for qualifying for a meta-game award based on the number of primary lottery drawing entries registered in a group. This information can be used to calculate, e.g., the registration price per entry 136 and to set the available award(s) 140 and the primary lottery award threshold 142.

Referring now to FIG. 4, a table 152 represents an embodiment of a registration database 150 that may be stored in the data storage device 112 (FIG. 2). The table 152 includes data identifying registered meta-game groups. This information is contained in a number of fields of the table 152 including the fields 154–162. These fields specify (i) a group identifier 154 (ii) a player identifier 156, (iii) drawing identifier(s) 158, (iv) lottery number(s) 160, and (v) an award 162. In general, the data in the registration database is used by the program 120 in conjunction with the data in the price/award database 130 and the player information database 170 to register, control, and track the status of each meta-game.

The group identifier 154 may be, for example, an alphanumeric code associated with a particular group of primary lottery entries registered by a player. The group identifier 154 may be a number randomly selected by the controller 20 or may be based on information such as the player's telephone number, credit card number, driver's license number, Social Security Number, passport number, lottery card number, or the like. The player identifier 156 may be, for example, an alphanumeric code uniquely associated with a particular meta-game participant, and may be the same code as the group identifier 154 or may be a separately selected or generated number. The player identifier 156 may be based on the player's telephone number, credit card number, driver's license number, Social Security Number, passport number, lottery card number, or the like.

The table 152 also includes various data used by the program 120 (FIG. 2) to ascertain whether or not a given group registered by a player qualifies for a meta-game award. This data includes drawing identifier 158 and lottery number(s) 160. In one embodiment, a group may be formed from primary lottery drawing entries from different primary lottery drawings, and the table 152 may include more than one drawing identifier 158 for a particular group.

The table 152 also includes data used by the program 120 to determine award status. For example, the table 152 may include an award field 162 which includes information indicating an award status of each registered group. A meta-game award may be ascertained by comparing the total number of lottery number(s) 160 registered in a group with the data in price/award database 130 to ascertain a level of award for which a player qualifies. The award field 162 may be, e.g., an indication of the status of each specific meta-game such as "pending", "not a meta-game winner" or a specific value or type of award if applicable.

Referring now to FIG. 5, a table 172 represents one embodiment of the player information database 170 that may be stored at the data storage device 112 (FIG. 2). The table 172 includes entries that identify specific meta-game players and also includes entries that track an award account of those players. The table 172 defines fields 156, 174, 176, 178 and 180 for the data. The fields specify (i) a player identifier 156, (ii) a player name 174, (iii) a payment identifier 176, (iv) player contact information 178, and (v) a player account balance 180. This information may be entered into player information database the first time that a new player registers primary lottery drawing entries in a meta-game. This information is preferably obtained from the player at the time he or she registers one or more primary lottery drawing entries in a meta-game (e.g., either at a point of sale device where the primary lottery entries are originally purchased as described in conjunction with FIG. 8 below or after purchase at a terminal connected to a lottery controller as described in conjunction with FIG. 9 below). In some embodiments, a player may choose to remain anonymous and only the player identifier 156 is used to identify the player (e.g., the player name 174 and the player contact information 178 need not be provided).

The player identifier 156 may be an alphanumeric identifier uniquely identifying a particular player and may be identical to the player identifier of the table 152 in FIG. 4. The player identifier 156 may be the player's telephone number, credit card number, driver's license number, social security number, passport number, lottery card number, or the like. Alternatively, or in addition, the player identifier 156 may be a unique number generated by the controller 20 as each player registers. As a further alternative, the player identifier 156 may be the same as the group identifier 154 (FIG. 4).

The fields 174 and 178 are optional fields containing data allowing the meta-game lottery operator or sponsor to contact a player. The payment identifier 176 may be, e.g., a credit card number and expiry date or an identifier of a payment account to be debited for purchases of meta-game entries. A player who wishes to use cash to enter meta-games would not need to supply information for this field. Storing payment identifier data, such as a credit card number or bank account number in the table 172, streamlines the payment process for subsequent participation in meta-games. When paying for registration in subsequent meta-games, the player may simply provide identifying information, such as the player identifier 156 to the controller 20, which retrieves the player's payment identifier 176 from the player information database 170.

The player account balance 180 is used, in one embodiment of the invention, to track and manage a player's meta-game award account balance. The player account balance 180 may contain data representing a dollar value of awards accumulated by a player or may contain data representing a credit value of credit points accumulated by the player. The data in player information database is used by the program 120 to identify players and, in one embodiment, to maintain and update the player account balance 180.

The information in the table 172 can be used for multiple meta-games. In one embodiment, once a player has registered for a first meta-game and provided player information, the information need not be re-submitted to register for future meta-games. For example, the first time a player registers for a meta-game, he or she may provide information including a name, contact information, and a payment identifier. The player is also issued or asked to,provide a player identifier. When the player registers for future meta-games, only the player identifier need be provided. Further, the player identifier serves to access the player account balance 180 allowing meta-game players to accrue points or money towards the purchase of higher value awards.

In alternative embodiments, the registration database 150 and the player information database 170 may be combined into a single database or further split into multiple databases as needed. In other embodiments, e.g., where a player account balance 180 will not be maintained, player information will not be gathered. Instead, a registered group will be identified only by a group identifier and the player information database 170 need not be referenced.

Referring now to FIG. 6, a table 192 represents an embodiment of the winning numbers database 190 that may be stored in the data storage device 112. The table 192 includes data identifying a specific primary lottery drawing and the outcome of that specific primary lottery drawing. This information is contained in a number of fields of the table 192 including fields 194 and 196. These fields specify a drawing date 194, and a set of winning numbers 196. In general, the data in winning numbers database is used by the program 120 in conjunction with the data in the registration database 150 to determine whether a specific registered group is entitled to a meta-game award. Preferably, the information in the table 192 is updated on a regular basis to ensure that the system has current information regarding the outcome of primary lottery drawings. Alternatively, the table 192 may be stored at a primary lottery controller to ensure it contains accurate and current information regarding the outcomes of primary lottery drawings.

In one embodiment of the present invention, all of the primary lottery drawing entries in a group must "lose" in the primary lottery drawing to "win" an award in the meta-game. In this embodiment, if the player registers, e.g., a group of two primary lottery drawing entries in a meta-game, both primary lottery drawing entries in the group must fail to win an award in the primary lottery drawing before the player qualifies for a meta-game award based on the group. This embodiment is depicted by referring to the third record of the table 192 (FIG. 6) and the first record of the table 152 (FIG. 4) where player 1111-2222-3333-4444 registered a group (with a group identifier of 1111-2222-3333-4444) of two primary lottery entries in the Dec. 30, 1999 primary lottery drawing and failed to win a primary lottery award for either of the entries. As shown in FIG. 4, the player qualified to win a meta-game award of twenty credit points, which was the award level established in the price/award table 132 for a registered group containing two entries.

In an alternative embodiment, to qualify a player for a meta-game award, the player's group has to fail to win an award in the primary lottery drawing on at least one of the registered entries in the group. For example, if a player registers a group of four primary lottery drawing entries in a meta-game and one of the four entries matches the minimum three out of six numbers in the primary lottery drawing (i.e., wins an award in the primary lottery drawing), the player will not qualify to win a meta-game award based on that group.

In still another embodiment, a player may qualify to win a meta-game award even if one or more entries of the player's group wins an award in the primary lottery drawing. In this embodiment, a player could qualify to win a meta-game award so long as the prize won by entries of the player's group in the primary lottery does not exceed a certain threshold. The threshold is preferably set by the meta-game or primary lottery sponsor. This threshold can be a fixed value or it can vary based on different criteria. For example a meta-game sponsor may establish a higher threshold for large groups than for small groups.

For example, the meta-game sponsor could establish a threshold of $10 for total winnings from a registered group of five primary lottery drawing entries. In this example, the group could qualify the player for a meta-game award even if one of the primary lottery drawing entries of the group won $9 in the primary lottery drawing. This same threshold could apply if the primary lottery drawing entries of the group won a combined total of $9 (e.g., the player would qualify for a meta-game award if three of the five tickets of the registered group each qualified for awards of $3 apiece from the primary lottery drawing). As a further alternative, the threshold can be established for each individual registered entry. For example, a meta-game sponsor could establish a threshold of $3 for each registered entry in a group. If a player has registered five primary lottery drawing entries as a group and qualifies for a $2 award on each of them in the primary drawing, the player still qualifies for a meta-game award.

The threshold at which a player qualifies for a meta-game award may be set at any prize or monetary level by the meta-game sponsor or authority. For example, the meta-game sponsor may simply set the threshold at the top jackpot level. In this example, a player can qualify for a meta-game award so long as none of the entries of the player's group has won the top jackpot in the primary lottery game. The criteria for receiving an award in the meta-game may vary and may be modified as needed or desired by the meta-game sponsor or authority.

In one embodiment, the meta-game sponsor or authority may also vary the size and/or type of awards granted to meta-game players. For example, the awards may include: credits toward free entries in a future primary lottery drawing, coupons redeemable at sponsoring establishments, merchandise, services, cash, and/or credit points toward merchandise or services.

Frequent meta-game players may have a meta-game account established. The balance of this account may be tracked, e.g., in the player account balance field 180 of the player information database 170 (table 172 of FIG. 5). A player's account may be credited with a certain number of credit points each time the player's group of primary lottery drawing entries qualifies for a meta-game award. These points may be redeemed for merchandise awards. The player may accumulate credit points over a certain time period, for example, during a single calendar year, which then may be redeemed at the end of the year toward merchandise or services. Alternatively, or in addition, the player's account may be credited with cash value which may be redeemed once it reaches a certain dollar value or as desired by the player.

As an illustrative example, a meta-game sponsor or authority may establish award rules where a player who has won, or accrued sufficient meta-game award credits may select from a clock radio valued at "100" credit points, a tennis racket valued at "1,000" credit points and a television valued at "4,000" credit points. Each time a group registered by the player wins an award in the meta-game, the player's account balance is increased by the appropriate number of credit points. Accordingly, in this example, the player would need to accumulate a minimum of "100" credit points in the account to qualify for the clock radio. Ideally, the player will register larger groups, such as ten, twenty or more primary lottery game entries for the meta-game, so that the player will have a chance to immediately qualify for an award, such as the clock radio, if the player loses on each entry in the primary lottery drawing. Variables such as the amount of credit points awarded for each meta-game award, the value of credit points, and the selection of merchandise awards will typically be set by the lottery sponsoring authority, such as the state, local merchants or companies that may sponsor the meta-game.

In another embodiment, each group of primary lottery drawing entries registered by a player which qualifies for a meta-game award may also be assigned a predetermined or arbitrary nominal cash value, such as $0.10 per a winning group containing a single primary lottery entry or a graduated set of values such as $1.37 for a winning group of five primary lottery entries and $3.01 for a group of ten primary lottery drawing entries. Such monetary values, instead of credit points as discussed above, may be used to calculate eligibility for awards and also allow a player to receive a cash meta-game award for a winning group. In this embodiment, the player may qualify for a meta-game award value which may be in excess of or less than the required value for redemption of an award. For example, if the player's meta-game award is valued at $3.01, the player may redeem for merchandise valued at $3.00, thereby leaving a leftover or excess of $0.01. This excess amount may be stored in an account maintained by the lottery sponsor (e.g., the player account balance field 180 of the player information database 170). The player is free then to accumulate additional value in the account by playing additional meta-games. Ideally, fractional amounts, such as the leftover $0.01 in this example, are stored until they reach whole dollar amounts such as $1.00 at which time the player may redeem the credits for a meta-game award valued at the whole dollar amount.

In one embodiment of the present invention, the odds of a player qualifying for a meta-game award are directly related to the odds of losing in the primary lottery game. For example, as the odds of winning in the primary lottery game decrease, the odds for winning in the meta-game increase and vice versa. Specifically, in a typical 6/49 Lotto type game, the approximate odds for matching six out of six numbers is one in 13,983,816; five out of six numbers is one in 55,492; four out of six numbers is one in 1,033; and three out of six numbers is one in fifty-seven. If a player purchases a group of five primary lottery drawing entries, the odds of the player winning anything, e.g. matching three out of six numbers, will be approximately 9%, while the odds of the player qualifying for a meta-game award will be approximately 91%. Correspondingly, as the player buys more tickets to the primary lottery game, the chances of the player qualifying for a meta-game award decrease.

Figure 7:
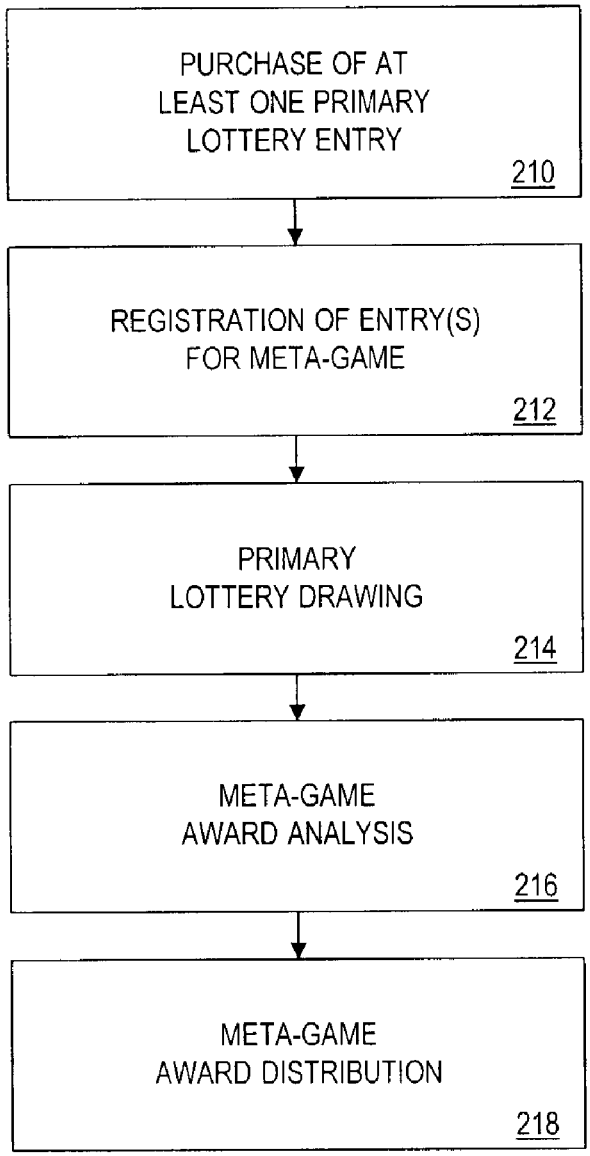
FIG. 7 is a flowchart illustrating a set of steps for operating a meta-game.

Referring now to FIG. 7, an overview of one embodiment of a meta-game process according to the present invention is shown. According to one embodiment of the invention, a player first purchases at least one primary lottery drawing entry (step 210). This purchase may be accomplished, e.g., at a conventional lottery terminal which may be at a convenience store, supermarket, drugstore, lottery outlet or other establishment which has been authorized by, for example, a state's lottery commission to sell lottery entries. The primary lottery entry(s) may be entries to any type of lottery drawing.

Once the player has purchased at least one primary lottery drawing entry, the player registers for a meta-game (step 212). This registration process, which will be described in more detail in conjunction with FIGS. 8 and 9, establishes or updates information in the registration database 150 and the player information database 170 (see FIGS. 4 and 5). As will be discussed, a player will typically register a group of primary lottery drawing entries in a meta-game. The player may register the entire group from a single terminal or may register primary lottery drawing entries in the group from different terminals and at different times.

After the primary lottery drawing has been held (step 214), the controller 20 performs a meta-game award analysis (step 216) to determine which registered groups have won meta-game awards. Alternatively, this analysis may be performed on an individual group basis when a player attempts to redeem an award or when a player contacts the controller 20 to verify if a group registered by a player has qualified for a meta-game award. This meta-game award analysis will be described in more detail in conjunction with FIG. 10.

Each meta-game concludes, for example, with a distribution of meta-game awards (if any) (step 218). Award distribution may include a variety of forms of distribution. For example, awards may be distributed by: providing an award directly to the player (e.g., as cash, coupon, or merchandise), crediting a player account with the value of the award in either credits or cash value, shipping the award to the player (e.g., as a check, coupon, or merchandise), etc. This award distribution process is described in more detail in conjunction with FIG. 11.

Figure 8:
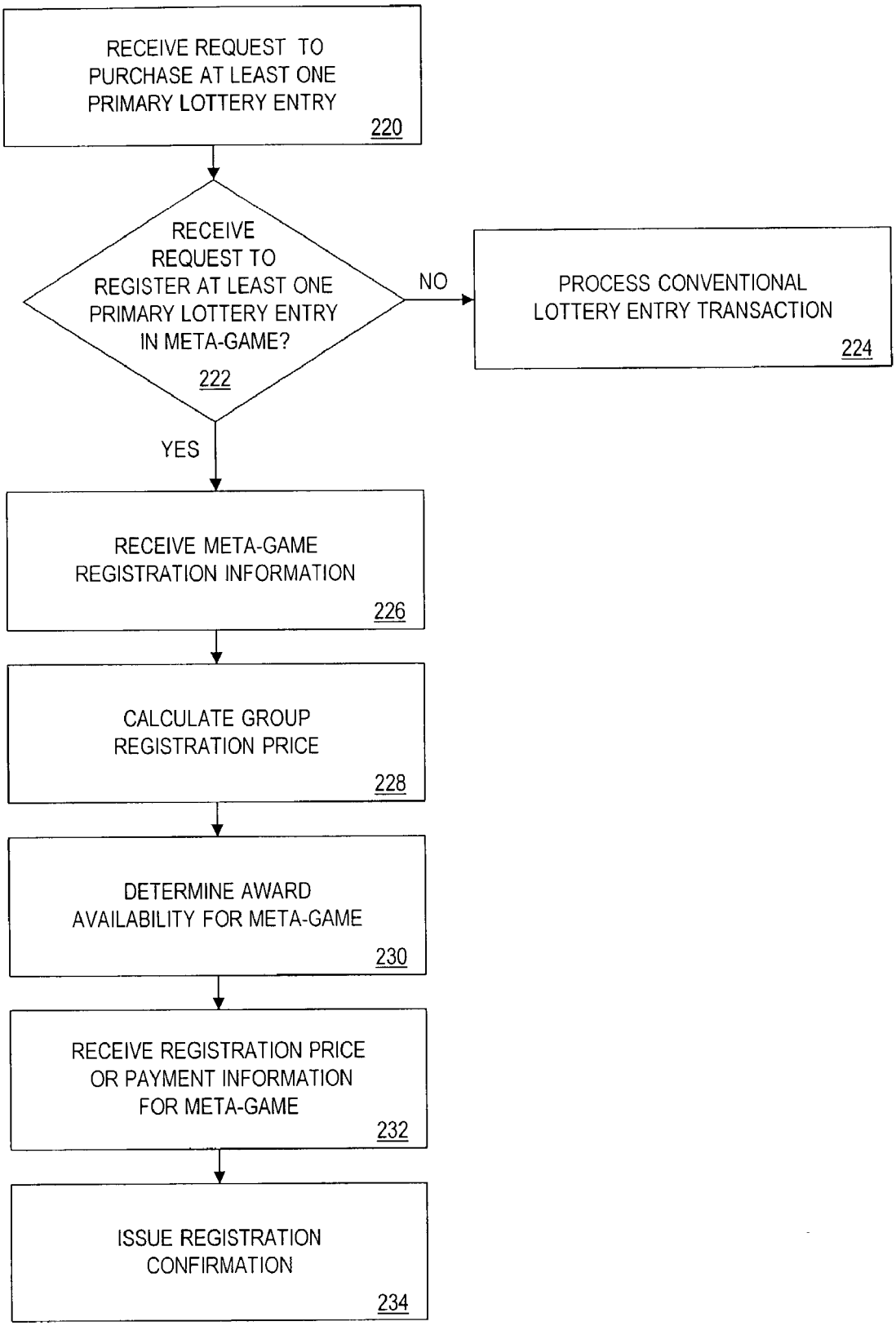
FIG. 8 is a flowchart illustrating a set of steps for registering a group of primary lottery drawing entries for a meta-game.

Referring now to FIG. 8, one embodiment of a player registration process is shown. In this embodiment, a player purchases one or more primary lottery drawing entries and registers those entries as a group in a meta-game during a single transaction session. In this embodiment, a player visits a lottery terminal or lottery outlet to purchase at least one entry in a primary lottery drawing. The controller 20 receives the player's request via a lottery terminal for at least one primary lottery entry (step 220). The player is then given the option to register at least one primary lottery entry as a group (step 222). If the player chooses not to register at least one primary lottery entry as a meta-game group, the transaction is processed as a conventional lottery entry transaction (step 224) and no meta-game is established for that player (i.e,. the player wins an award only if the entry wins an award in the primary lottery drawing).

If, however, the player does choose to proceed and to register at least one primary lottery drawing entry as a meta-game group, the process continues to step 226 where the player is asked to provide meta-game registration information to the controller 20 (step 226). The amount of registration information provided may vary. For example, a player may wish to register several primary lottery drawing entries as a group in a meta-game yet also wish to remain anonymous. In this case, no player information will be provided in the registration step, and the only information transmitted to the controller 20 will be a list of the primary lottery drawing entries in the group and a drawing identifier for the group (typically a date of the primary lottery drawing).

As another example, where the player does not wish to remain anonymous or where the player has already established or wants to establish a player account (field 180 of FIG. 5), more registration information may be provided at this step 226. For example, the player may provide his or her name and contact information. Further, where the player knows or has been assigned a player identifier (field 156 of FIG. 5), the player identifier may also be provided in this step. Each of these pieces of information received during registration step 226 are stored in appropriate fields of the registration database 150 and the player information database 170.

This registration information is used to determine a group registration price (step 228). In one embodiment, the number of primary lottery entries registered by the player is compared with data from the price/award database 130 (table 132 of FIG. 3) to arrive at a total group registration price. In another embodiment, the controller 20 retrieves a pre-calculated price for the number of entries being registered in a database. In one embodiment of the present invention, the price is determined wholly or partially at the lottery terminal at which the registration is taking place.

The registration information is then used to determine an award availability for the meta-game (step 230). In one embodiment, the number of primary lottery entries in the group being registered by the player is compared with data from the price/award database 130 (table 132 of FIG. 3) to determine available awards for the group. This information may be communicated to the player through the lottery terminal and may, in one embodiment, permit the player to select between alternative or multiple awards.

Once registration information has been received, a meta-game registration price has been calculated, and award availability has been established, a registration price or payment information for the meta-game is received (step 232). In one embodiment, where the player has previously established a player identifier and has previously provided payment information, this step may simply entail seeking confirmation from the player that the player wishes to use pre-stored payment information (e.g., a credit card number stored in the table 172). Alternatively, the player may be prompted to enter payment information to pay for the meta-game registration price. As a further alternative, at an attended lottery terminal or at a lottery terminal with an ability to receive cash payments, the player may choose to pay the registration price with cash. In a further embodiment, a player who has a credit balance in player account (field 180 of FIG. 5) may be given the option to apply that balance to cover the meta-game registration price. Further, the credit balance may also be used to cover the price of registration for the primary lottery drawing.

In one embodiment, the player pays for both the primary lottery drawing entry(s) and the meta-game registration price at the same time. It is possible, however, that payment for the primary lottery drawing entry(s) and the meta-game could be processed separately, for example, in the case where the primary lottery drawing and meta-game are administered by separate organizations.

At the completion of registration, a confirmation is issued to the player indicating that he/she is registered in a meta-game (step 234). This confirmation may come in any of a number of forms, for example, the player's entry ticket to the primary lottery drawing may serve as confirmation. Alternatively, a separate confirmation may be printed by the lottery terminal (e.g., a meta-game receipt or ticket) or may simply be displayed to the player on a display device. In one embodiment, the lottery terminal outputs a confirmation ticket or receipt which may contain information such as the date of the primary lottery drawing for which the group is entered, the group identifier of the registered group, the number of entries in the group, the amount paid for the meta-game, award options and other relevant information. Such confirmation information may also be printed directly or affixed to the player's primary lottery ticket(s). Promotional advertising may also be provided on the confirmation, which may include advertising from the meta-game sponsor or lottery sponsoring organization. Other forms of confirmation may also be used; for example, the controller 20 may issue an e-mail or telephone confirmation to the player (if the player provided an e-mail address or telephone number as part of identifying information during the registration process), etc.

The embodiments shown and described above in conjunction with FIG. 8 provide players with the opportunity to register a group of primary lottery entries for a meta-game concurrently (or in the same session) with the purchase of those entries. It is contemplated that in some situations, players will want to register a group of primary lottery entries for the meta-game after having already purchased those entries. In such a situation, the player will have the opportunity to register for the meta-game in accordance with embodiments of the present invention as shown and described below in conjunction with FIG. 9.

Figure 9:
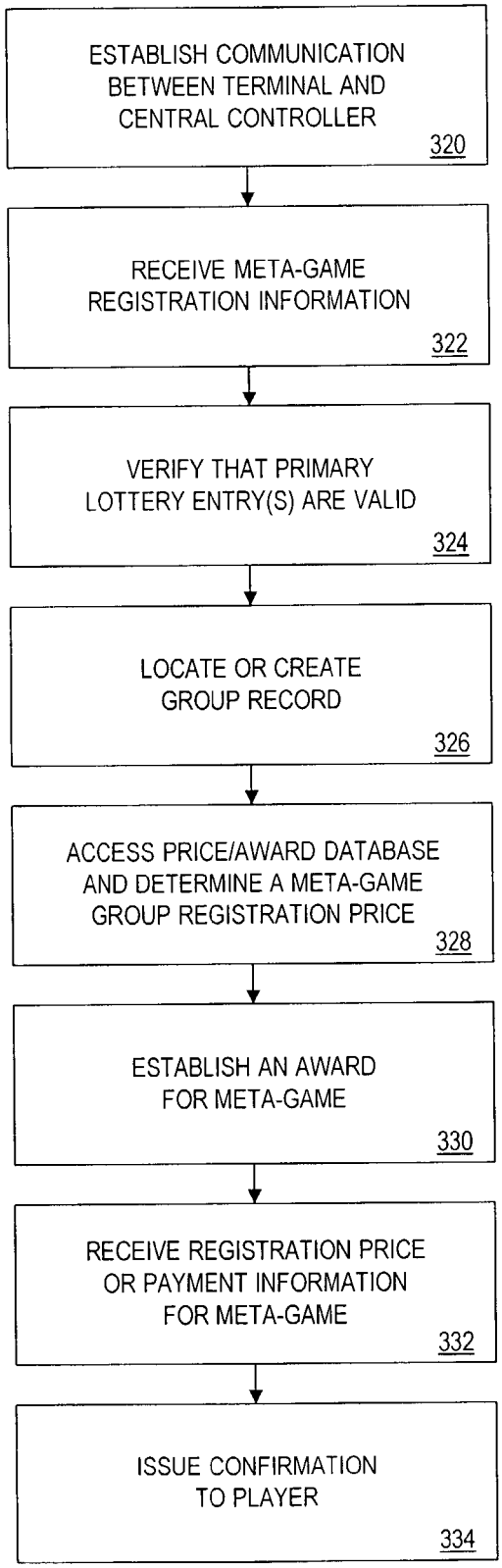
FIG. 9 is a flowchart illustrating another set of steps for registering a group of primary lottery drawing entries for a meta-game.

In the registration embodiment described in conjunction with FIG. 9, a player may register already-purchased primary lottery entries in a meta-game. This registration may occur from any of a variety of types of terminals (items 22–28 of FIG. 1) such as a computer, PDA, wired or wireless telephone, lottery terminal, etc. The registration process of FIG. 9 starts when a player operating an terminal establishes communication with the controller 20 (step 320).

Once the player has established communication with the controller 20, the player submits meta-game registration information to the controller (step 322). This registration information includes information identifying a group of primary lottery entry(s) and, in one embodiment, player identifying information. This information may be submitted to the controller 20, for example, by inputting the information into an online HyperText Markup Language (HTML) form using a keyboard and then transmitting the information using HyperText Transfer Protocol (HTTP), for example, via an HTML form using the HTML "POST" command, through the browser software to the controller 20.

Upon receipt of this information, the controller 20 performs a first check to verify that the primary lottery entry(s) are valid (step 324). In particular, the controller 20 ensures that the lottery drawing for the primary lottery entry(s) has not already occurred. If the lottery drawing has already occurred, the player is informed that the entry(s) cannot be entered as a group in a meta-game. The player may then be given the option to register a different group of primary lottery drawing entries.

Once at least one primary lottery entry has been determined to be valid, program 120 accesses registration database (table 152 of FIG. 4) and locates or creates a new group record (step 326). If the player has already started a group, the player can add to the group at this time by providing the group identifier (field 154 of FIG. 4) to reference the already-established group. Further, if the player has previously registered for meta-games and has a player identifier (field 156 of FIG. 5), the player may also provide his or her player identifier to retrieve player information from player information database 170. Alternatively, a new player record can be established at this time if the player wants to provide details such as a player name or contact information or if the player wishes to establish a player account (items 174, 178 and 180 respectively, of FIG. 5). Program 120 then operates to store registration information in the registration database and the player information database (items 150 and 170 of FIG. 2). For example, the group identifier (either newly generated or retrieved from table 152), drawing identifier, and primary lottery number(s) are entered into registration database at this time (fields 154, 158, and 160 of table 152 respectively).

In one embodiment, where the player uses a terminal to log onto a Web page maintained by the controller 20, the controller 20 may automatically detect the identity of the player, for example, by using a "cookie" stored on the terminal (e.g., on a personal computer of the customer). Such a cookie is a block of data that a Web server (e.g. the controller 20) stores on a client system (e.g. a player's terminal). When a user returns to the same Web site, the browser of the player terminal sends a copy of the cookie back to the Web server. Cookies may be used to identify players, to instruct the Web server to send a customized version of a Web page, to submit account information for the player, and for other administrative purposes. The "cookie" identifies the player to the controller 20 once the player establishes a communication with the controller 20.

The program 120 then operates to access the price/award database (table 132 of FIG. 3) to determine a group registration price (step 328) and establish an award for the meta-game (step 330). For example, if the player is registering a group of five primary lottery entries in the meta-game, the program 120 will look up the appropriate price in the price/award database 130 and determine, e.g., that the group registration price for the meta-game will be $1.25 and that the player will be eligible to win a cash award of $1.37 or 30 credit points. This information can then be used to update registration database 150 (table 152 of FIG. 4).

Once a group registration price for the meta-game has been established, the player is prompted to enter payment information to pay the group registration price (step 332). In one embodiment, where the player has previously established a player identifier and has previously provided payment information, this step may simply entail seeking confirmation from the player that the player wishes to use pre-stored payment information (e.g., a credit card number stored in table 172). Alternatively, the program 120 may prompt the player to enter payment information to pay for the group registration price. As a further alternative, at an attended lottery terminal or at a terminal with an ability to receive cash payments, the player may choose to pay the group registration price with cash. In a further embodiment, a player who has a credit balance in the player account 180 (FIG. 5) may be given the option to apply that balance to cover the group registration price.

After the player has paid the group registration price, registration is complete and the controller 20 issues a confirmation message to the player (step 334). Confirmation may be provided in the form of a meta-game receipt or ticket printed by the terminal. In one embodiment, the terminal will output a confirmation ticket or receipt which may contain information such as the date of the primary lottery drawing for which the group is registered, the number of entries in the group, the amount paid for the group registration, award options and other relevant information. Promotional advertising may also be provided on the confirmation, which may include advertising from the meta-game sponsor or lottery sponsoring organization. Other forms of confirmation may also be used; for example, the controller 20 may issue an e-mail or telephone confirmation to the player (if the player provided an e-mail address or telephone number as part of identifying information during the registration process), etc.

Figure 10:
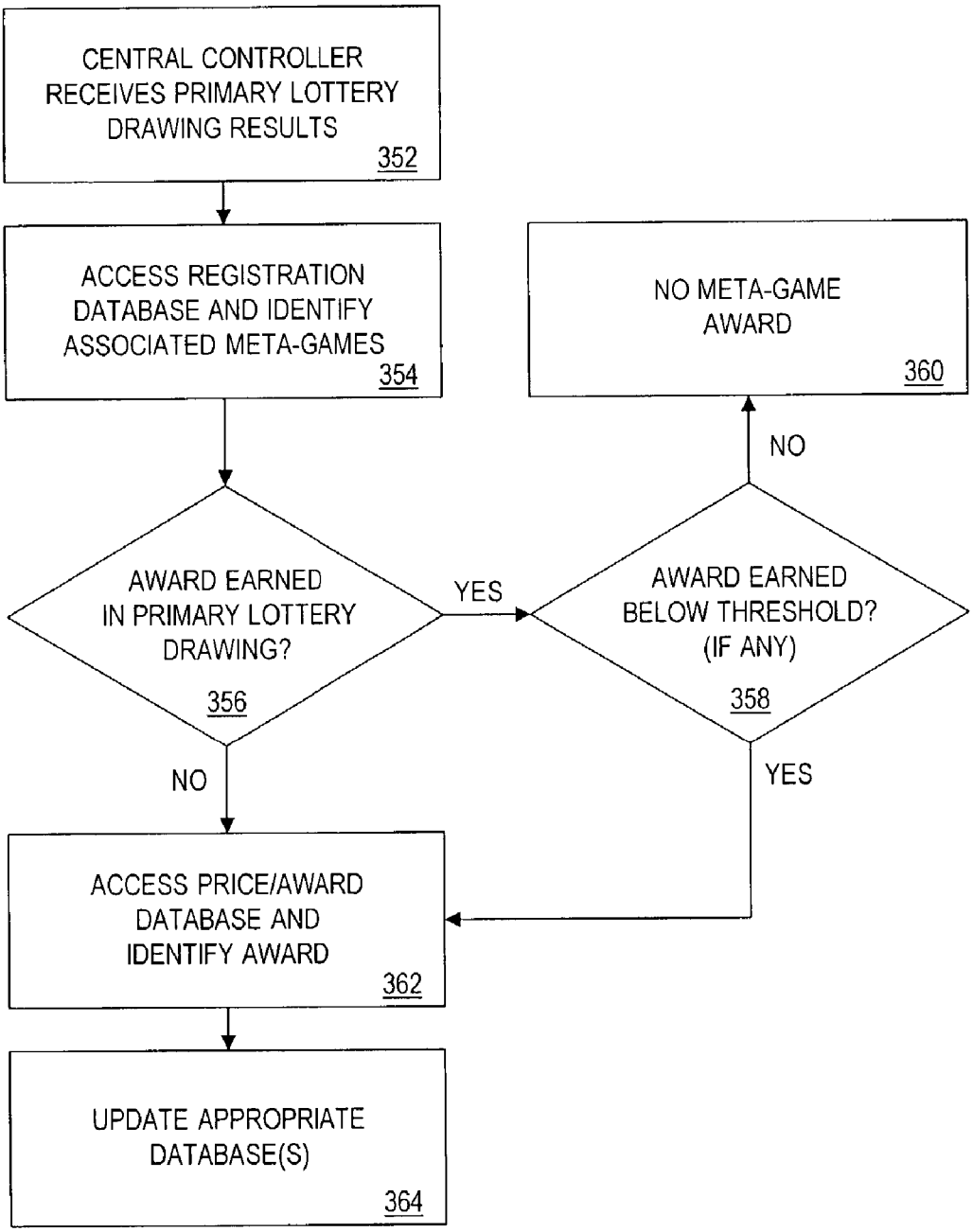
FIG. 10 is a flowchart illustrating a set of steps for performing an award analysis.

Once the player has properly registered a group for the meta-game (using either the registration embodiment of FIG. 8 or FIG. 9), the player waits for the occurrence of the primary lottery drawing for which entries of his or her group is registered. Referring now to FIG. 10, a process is shown by which a meta-game award analysis may be performed according to an embodiment of the present invention.

In one embodiment, the controller 20 receives primary lottery drawing results (step 352) on a regular basis (e.g., daily). These primary lottery drawing results may be provided to the controller 20 in electronic format via, e.g., the Internet, magnetic tape, or other means from the primary lottery drawing operator or sponsor. For example, if the primary lottery drawing is held nightly, primary lottery drawing results may be transmitted to the controller 20 via the Internet or a proprietary network shortly after the primary lottery drawing results are known. In particular, the primary lottery results transmitted to the controller 20 preferably contain information such as that depicted in FIG. 6 (the winning numbers database 190), such as the drawing identifier 194 and the winning numbers 196.

Once the controller 20 receives this information, the registration database 150 (table 152 of FIG. 4) is accessed to identify relevant meta-games (step 354). A relevant meta-game is a meta-game which included primary lottery entries from the primary lottery drawing identified by the drawing identifier 158 (table 152 of FIG. 4).

After identifying relevant meta-games, the program 120 operates to determine (for each relevant meta-game) if an award was earned in the primary lottery drawing for any of the groups of registered primary lottery drawing entries (step 356). This is accomplished by comparing the updated information stored in the winning number field 198 of the winning numbers database 190 (FIG. 6) with meta-game registration information stored in the registration database 150 (table 152 of FIG. 4).

If it is determined that a primary lottery drawing award was earned by primary lottery drawing entry(s) of a group, the process continues to step 358 to determine whether the primary lottery drawing award which was earned by entry(s) of the group was below a set threshold. As discussed above, in some embodiments, a player may qualify for a meta-game award based on a group, even if entries of the group also won an award in the primary lottery drawing. Lottery operators or sponsors may establish thresholds defining when a group can win a meta-game award in this situation. In step 358, it is determined whether any such thresholds have been established for a given registration by examining fields of the price/award database 130 (table 132 of FIG. 3). If no threshold has been established, the player does not qualify for a meta-game award based on the group (step 360).

If a threshold has been established, the primary lottery drawing award is compared with the established threshold. If the primary lottery drawing award is below the established threshold, processing continues to step 362 to determine what type or amount of meta-game award has been earned by a player based on a particular group.

If it is determined that no award was won in the primary lottery drawing for a given meta-game group, or if it is determined that the primary lottery drawing award qualifies because it was below an established threshold, the process proceeds to step 362 where the price/award database 130 is accessed to identify an award. For example, if a player has registered a group of five primary lottery drawing entries in a meta-game and failed to qualify for an award on any of them in the primary lottery, the program 120 will look up the appropriate record in the price/award database 130 and determine that the player qualifies for a meta-game award of either thirty credit points or a cash award of $1.37. In one embodiment, the controller 20 will select which of the alternative awards are to be issued to the player. In another embodiment, the player may be given a choice between the available awards.

The award analysis finishes when appropriate databases are updated (step 364). For example, award information may be written to the award field 162 in the registration database 150 (table 152 FIG. 4). Alternatively, or in addition, if a player has qualified for a cash or point award, the award may be automatically credited to the player identification database 170 (e.g., by updating the data in the player account balance field 180).

Once the player has determined that he/she qualifies for an award in the meta-game, for example by watching the primary lottery drawing on television, obtaining the winning numbers from a newspaper or magazine, logging onto a web page maintained by the lottery authority or other similar ways, the player may submit or redeem a meta-game registration for an award. In one embodiment, rather than performing an award analysis on all groups on periodic intervals, the meta-game award analysis (step 216 of FIG. 7) is performed only when a player attempts to collect a meta-game award. For example, the award analysis may be performed when a player, believing that he or she won a meta-game award, contacts the controller 20 using a terminal to collect the award.

Figure 11:
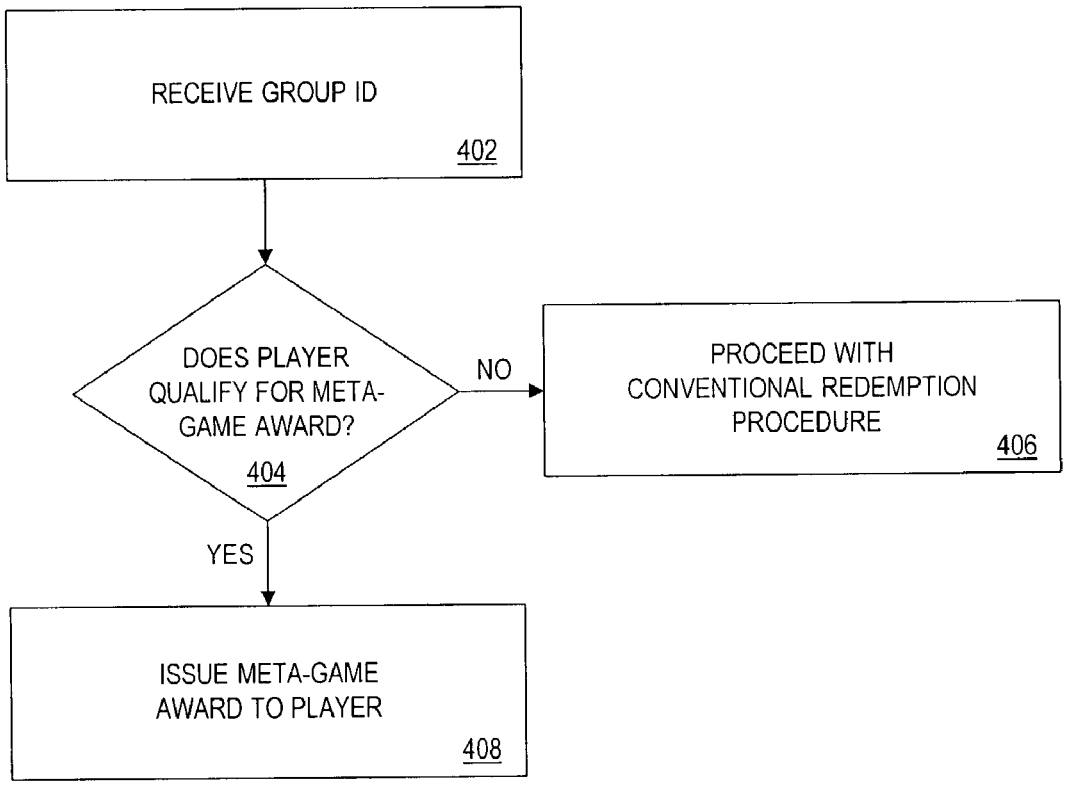
FIG. 11 is a flowchart illustrating a set of steps for providing a meta-game award.

FIG. 11 illustrates an embodiment of a process by which a player redeems a meta-game registration for a meta-game award. In this embodiment, the player accesses the controller 20 via a terminal 22–28. The player first submits at least one meta-game group identifier (field 154 of FIG. 4) to the controller 20 (step 402). This may be accomplished by simply providing the group identifier to the terminal 22–28. The terminal may be a lottery terminal of the operator-assisted variety where a lottery terminal operator will assist in processing the entry or may be a self-serve lottery terminal which has, e.g., a keyboard for entering the group identifier or a scanner for reading information from, e.g., a receipt.

The group identifier is then used by the program 120 at controller 20 to determine if a particular meta-game group has qualified a player for a meta-game award (step 404). This step is performed using the group identifier 154 to retrieve data from the award field 162 of the registration database 150 (table 152 of FIG. 4) (if the award analysis process of FIG. 10 has been performed). If the award analysis of FIG. 10 has not been performed, the step of determining if a player has qualified for a meta-game award is performed using the group identifier 154 to retrieve information about the player's registered group including the drawing identifier(s) 158 and the lottery number(s) 160. Each of the primary lottery drawing entry numbers of the group are then compared with data from the winning numbers database 190 to determine if the qualified for a meta-game award. A player may have qualified for both a meta-game award and a primary lottery drawing award if an award threshold was established for the group as described above.

If the player did not qualify for a meta-game award in the meta-game, e.g., if the player has matched three or more numbers in the primary lottery drawing and the award exceeded any meta-game threshold, the lottery entry may then be redeemed for a prize in the primary lottery game (step 406). This may be accomplished at the same lottery terminal during a single transaction session.

If the player has qualified for a meta-game award, the player is issued a meta-game award (step 408). The manner of issuance depends, e.g., on the type of award earned. For example, if a player has qualified for a monetary or point award, the award may be credited directly to the player's account 180 in the player information database 170 (table 172 of FIG. 5) or it may be paid out directly to the player. If, e.g., a player has qualified for a coupon or certificate as an award, the coupon or certificate may be printed directly at the terminal or may be mailed or delivered to the player at a later time. In some embodiments, a player may have several awards from which to choose and may do so at step 408.

In other embodiments, where an award analysis has already been performed as described in FIG. 10, the player may obtain an award in the meta-game simply by presenting some personal identifying information, such as a player identifier, credit card number or driver's license number. Upon receipt of this information, the controller 20 can query the registration database and winning numbers database to determine if the player is a winner of the meta-game and to determine what type of an award has been won.

The process steps of the present invention may also be implemented on an Interactive Voice Response Unit (IVRU) or similar system which is responsive to Dual-tone Multi Frequency (DTMF) tones and/or signals recognizes speech. In such a system, the player may dial a meta-game lottery telephone number, such as an 800#, 877#, 888# or 900# number and interact with the controller 20. The controller 20 may be attended by an actual operator or the player may be prompted by the IVRU. The IVRU may prompt the player for his or her identification, which the player may enter into the keypad of the telephone. The player's identification is communicated to the controller 20 which checks, for example, the registration database to determine if the player is a recognized participant. If not, the player may register with the controller 20, again via the telephone keypad or voice recognition system. Once the player is verified, the IVRU prompts the player for meta-game information, such as their primary lottery drawing entry identifying information. The player enters his primary lottery drawing entry identifying numbers into the telephone. The controller 20 checks the information to determine, for example, whether the entries have expired and whether the entries are eligible for the meta-game. If the entries are valid, the controller 20 checks to determine if the player has an existing credit in their account, has pre-paid for the meta-game, and/or owes a registration price for the meta-game. It is anticipated that payment for the meta-game may also be made through an advance account arrangement where the player pre-pays or is billed a certain price on some prescribed basis, such as a monthly debit to a credit card account. If a registration price is required, the IVRU prompts the player for payment, such as a credit card number. The player may enter the credit card number into the telephone or simply speak the credit card number into the telephone receiver in the case of a voice recognition system. The validity of the credit card may then be checked in a primary manner. If the credit card is valid, the player is then registered for the meta-game. The player may then be issued a confirmation for the meta-game, in the form of an identification number. Award redemption may also be provided via the IVRU whereby the player may provide ticket identifying information over the telephone, which is then processed by the controller 20. The controller 20 may then credit the player's credit card with the award or alternatively, the player may have a credit account which earns credit points toward merchandise as discussed earlier herein.

The present invention has been shown and described in what are considered to the most practical and preferred embodiments. It is anticipated, however, that departures can be made therefrom and, that obvious modifications will occur to persons skilled in the art.

We claim:

1. A method, the method comprising:

registering a plurality of lottery entries to define a group, wherein the group comprises the plurality of lottery entries, each lottery entry comprising a distinct and complete entry into a lottery game, and wherein registering comprises:

receiving a registration request;

determining respective identifying information associated with each of the plurality of lottery entries;

determining a group registration price; and issuing a registration confirmation;

generating a group identifier associated with the group; and providing a secondary award if the plurality of lottery entries of the group fail to win an award above a predetermined threshold in the lottery game.

2. The method of claim 1, wherein the step of registering is performed at a lottery terminal at the time the plurality of lottery entries are acquired.

3. The method of claim 1, further comprising the step of determining a secondary award availability for the group based on the number of lottery entries in the group.

4. The method of claim 1, wherein said secondary award comprises at least one of: (i) a cash award; (ii) an award certificate; (iii) credit points; (iv) merchandise; and (iv) one or more future lottery entries.

5. The method of claim 1, wherein the predetermined threshold is zero and each of the plurality of lottery entries must fail to win an award in the lottery drawing in order for the secondary award to be provided.

6. The method of claim 1, wherein the step of providing a secondary award further comprises the step of crediting a player account with the secondary award.

7. The method of claim 1, further comprising:

determining a set of winning numbers for the lottery game; and for each lottery entry of the plurality of lottery entries, determining whether the lottery entry qualifies for a respective award by comparing the lottery entry to the set of winning numbers.

8. The method of claim 1, in which the registration confirmation comprises a ticket for the lottery game.

9. The method of claim 1, further comprising:

receiving a request to purchase the plurality of lottery entries in a single transaction.

10. The method of claim 1, in which the registration confirmation comprises a receipt, the receipt indicating the plurality of lottery entries.

11. A meta-game system, comprising:

means for registering a plurality of lottery entries to define a group, wherein the group comprises the plurality of lottery entries, each lottery entry comprising a distinct and complete entry into a lottery game, and wherein the means for registering is operative to:

receive a registration request;

determine respective identifying information associated with each of the plurality of lottery entries;

determine a group registration price; and issue a registration confirmation;

means for generating a group identifier associated with the group; and means for providing a meta-game award if the plurality of lottery entries of the group fail to win an award above a predetermined threshold in a lottery game.

12. A computer-readable medium storing computer-readable instructions that direct a microprocessor to:

register a plurality of lottery entries to define a group, wherein the group comprises the plurality of lottery entries, each lottery entry comprising a distinct and complete entry into a lottery game, and wherein the instructions that direct the microprocessor to register the plurality of lottery entries comprises instructions that direct the microprocessor to:

receive a registration request;

determine respective identifying information associated with each of the plurality of lottery entries;

determine a group registration price; and issue a registration confirmation;

generate a group identifier associated with the group; and cause a secondary award to be provided if the plurality of lottery drawing entries of the group fail to qualify for an award in the lottery game exceeding a certain amount.

13. A method comprising:

receiving an indication of a first set of numbers of a player, a second set of numbers of the player, and a third set of numbers of the player, in which each of the first, second, and third sets of numbers is for one lottery drawing;

determining a set of winning numbers for the lottery drawing;

comparing, via a computing device, the set of winning numbers to each number of the first, second, and third sets of numbers to determine:

whether one or more of the first, second, and third sets of numbers qualifies individually for a respective primary award, and whether the first, second, and third sets of numbers qualify collectively for a secondary award; and providing the secondary award if the first, second, and third sets of numbers qualify collectively for the secondary award.

14. A method comprising:

determining a plurality of lottery entries of a player, in which each lottery entry of the plurality is a complete and individual entry in a lottery game;

determining a set of winning numbers for the lottery game;

for each lottery entry of the plurality of lottery entries of the player, comparing the lottery entry to the set of winning numbers, and determining whether the lottery entry qualifies for a respective primary award based on (i) the respective comparison and (ii) one or more first award rules applicable to the lottery entry as an individual entry;

determining, via a processing device, whether the plurality of lottery entries of the player qualifies for a secondary award as a group, based on (i) all of the respective comparisons of each lottery entry to the set of winning numbers and (ii) one or more second award rules applicable to the plurality of lottery entries as a group; and providing the secondary award if the plurality of lottery entries of the player qualifies for the secondary award.

15. The method of claim 14, in which determining the plurality of lottery entries comprises:

receiving, via a scanner, an identifier that identifies the plurality of lottery entries.

16. A method comprising:

determining a plurality of sets of numbers of a player, in which each set of numbers is valid for only a single lottery drawing;

determining a set of winning numbers for the single lottery drawing;

for each of the plurality of sets of numbers of the player:

determining, by a computer, a respective number of matches between the set of winning numbers and the set of numbers of the player, and determining, based on the determined respective number of matches, that the set of numbers of the player does not qualify for a primary award;

determining, based on the set of winning numbers for the lottery drawing, that the plurality of individual entries collectively qualifies for a secondary award; and outputting an indication of the secondary award for the player.

17. A method comprising:

determining a plurality of entries of a player for a single lottery drawing, in which each entry comprises a respective set of selected numbers, and in which the plurality of entries comprises a first entry and at least one other entry;

determining a set of winning numbers for the lottery drawing;

determining a number of matches between the set of winning numbers for the lottery drawing and the respective set of selected numbers of the first entry;

determining, based on the number of matches, that the first entry qualifies individually for a primary award;

determining, via a processing device, that none of the at least one other entry of the plurality of entries of the player qualifies individually for a primary award;

determining, based on the set of winning numbers for the lottery drawing, that the plurality of individual entries qualifies for a secondary award; and outputting an indication of the primary award and the secondary award for the player.

18. A method comprising:

determining a plurality of sets of numbers of a player, in which each set of numbers is valid for only one lottery drawing;

determining a set of winning numbers for the lottery drawing;

for each set of numbers of the plurality, determining fewer than three matches between the set of winning numbers for the lottery drawing and the respective set of numbers; determining, via a computing device, based on the set of winning numbers for the lottery drawing, that the plurality of sets of numbers qualifies as a group for a secondary award; and outputting an indication of the secondary award via a lottery terminal.

19. The method of claim 18, in which for each set of numbers of the plurality there are no matches between the set of winning numbers for the lottery drawing and the respective set of numbers.

20. A method comprising:

receiving an indication of at least a first entry and a second entry of a player in a single lottery drawing, in which the first entry is associated with a first set of numbers, and in which the second entry is associated with a second set of numbers;

determining a set of winning numbers for the lottery drawing;

determining a first number of matching numbers based on:

the set of winning numbers for the lottery drawing, and only the first set of numbers;

determining a payout for the first set of numbers based on the first number of matching numbers;

determining a second number of matching numbers based on:

the set of winning numbers for the lottery drawing, and only the second set of numbers;

determining a payout for the second set of numbers based on the second number of matching numbers;

determining, via a processing device, a secondary payout based on:

the first number of matching numbers, and the second number of matching numbers; and providing the secondary payout.

21. The method of claim 20, further comprising:

transmitting, via a lottery terminal, an indication of the payout for the first set of numbers, the payout for the second set of numbers, and the secondary payout.

22. The method of claim 20, in which the numbers of the first set of numbers are selected by the player.

23. The method of claim 22, in which the second set of numbers is a quick pick.

24. The method of claim 22, in which the second set of numbers is generated by a number generator.

25. The method of claim 22, in which the numbers of the second set of numbers are generated randomly.

26. The method of claim 22, in which the numbers of the second set of numbers are not selected by the player.

27. The method of claim 22, in which the numbers of the second set of numbers are selected by the player.

28. The method of claim 20, in which the numbers of the first set of numbers are not selected by the player and the numbers of the second set of numbers are not selected by the player.

29. The method of claim 20, in which the first set of numbers is a quick pick and the second set of numbers is a quick pick.

30. The method of claim 20, further comprising:

determining a primary payout based on the payout for the first set of numbers and the payout for the second set of numbers.

31. The method of claim 30, in which determining the primary payout comprises:

determining a sum of the payout for the first set of numbers and the payout for the second set of numbers.

32. The method of claim 20, in which determining the secondary payout comprises:

determining a primary payout based on the payout for the first set of numbers and the payout for the second set of numbers.

33. The method of claim 32, in which determining the primary payout comprises:

determining a sum of the payout for the first set of numbers and the payout for the second set of numbers.

34. The method of claim 32, in which determining the secondary payout comprises:

if the primary payout is zero, determining that the secondary payout is greater than zero.

35. The method of claim 32, in which determining the secondary payout comprises:

if the primary payout is greater than zero, determining that the secondary payout is zero.

36. The method of claim 32, in which determining the secondary payout comprises:

if the primary payout is greater than a predetermined amount, determining that the secondary payout is zero.

37. The method of claim 32, in which determining the secondary payout comprises:

if the primary payout is not greater than a predetermined amount, determining a secondary payout that is greater than zero.

38. The method of claim 32, in which determining the secondary payout comprises:

determining that the primary payout is greater than a predetermined amount; and determining that the secondary payout is greater than zero.

39. The method of claim 32, in which determining the secondary payout comprises:

if the first number of matching numbers is not greater than a predetermined number, determining a secondary payout that is greater than zero.

40. The method of claim 32, in which determining the secondary payout comprises:

if the first number of matching numbers is not greater than a first predetermined number, and the second number of matching numbers is not greater than a second predetermined number, determining a secondary payout that is greater than zero.

41. The method of claim 32, in which determining the secondary payout comprises:

determining that the first number of matching numbers is greater than a predetermined number; and determining a secondary payout that is greater than zero.

42. The method of claim 32, in which determining the secondary payout comprises:

determining that the first number of matching numbers is greater than a first predetermined number;

determining that the second number of matching numbers is greater than a second predetermined number; and determining a secondary payout that is greater than zero.

* * * * *